US007417517B2

(12) United States Patent
Hernandez et al.

(10) Patent No.: US 7,417,517 B2
(45) Date of Patent: Aug. 26, 2008

(54) METHOD AND APPARATUS FOR A COMMUNICATIONS FILTER

(75) Inventors: Gilberto J. Hernandez, Miami, FL (US); Edgar H. Callaway, Jr., Boca Raton, FL (US); Douglas H. Weisman, Sunrise, FL (US)

(73) Assignee: Motorola, Inc., Schaumburg, IL (US)

( * ) Notice: Subject to any disclaimer, the term of this patent is extended or adjusted under 35 U.S.C. 154(b) by 272 days.

(21) Appl. No.: 11/457,238

(22) Filed: Jul. 13, 2006

(65) Prior Publication Data

US 2008/0012662 A1 Jan. 17, 2008

(51) Int. Cl.
*H01P 1/20* (2006.01)

(52) U.S. Cl. ..... 333/204; 333/34; 333/202

(58) Field of Classification Search ..... 333/34, 333/202, 204

See application file for complete search history.

(56) References Cited

U.S. PATENT DOCUMENTS 3,585,499 A 6/1971 Bolie
5,856,722 A 1/1999 Haronian et al.
6,768,398 B2 7/2004 Callaway, Jr. et al.

*Primary Examiner*—Anh Q Tran

(57) ABSTRACT

A method and apparatus for a highpass filter structure using transmission line construction which has multiple output tabs for selection of corner frequencies utilizing a plurality of resonators coupled to the transmission line. The transmission line has a characteristic impedance which increases exponentially with respect to a distance from the input.

29 Claims, 13 Drawing Sheets

400

1200

METHOD AND APPARATUS FOR A COMMUNICATIONS FILTER

CROSS-REFERENCE TO RELATED APPLICATIONS

The present application is related to U.S. application Ser. No. 10/021,636, filed Dec. 12, 2001, entitled Method and Apparatus for Creating a Radio Frequency Filter, now U.S. Pat. No. 6,768,398.

FIELD OF THE INVENTION

The present invention relates generally to filters.

BACKGROUND

Passive lowpass, highpass, bandpass, and bandreject filters, including radio frequency (RF) filters, are commonly used in electronic equipment. Communications equipment in particular relies on the extensive use of passive filtering to aid in the extraction of a desired signal from noise and interference, to ensure spectral purity of transmitted signals, and other uses.

Multiband designs may use large numbers of switchable passive filters to make recovery of the desired signal feasible, economical, or to provide enhanced performance. Some switchable passive filters use varactors as the main tuning component, and several types of active filters have been suggested (i.e., gmC and logarithmic) but they all suffer from dynamic range and current drain limitations when compared to passive filter counterparts.

Filter hardware suitable for a Software Defined Radio (SDR) in general needs to be frequency agile. In order to be most useful, the hardware filters typically must be able to cover a wide bandwidth and be capable of providing various bandwidths at a particular operating frequency within a given frequency range of interest. Common radio applications require both wideband and narrowband filters, and the filter frequency of operation which is required depends on the radio design and the point of use of the filter within the radio.

SDR applications also require that properties of hardware bandpass and bandstop filters, such as center frequency and bandwidth, be controllable by software/digital means. Similarly, where highpass filtering is employed it is desirable that the highpass filtering have a selectable corner frequency under software control. Prior art flexible lowpass RF filters are incapable of meeting this flexible highpass RF filtering requirement.

No truly satisfactory solution to this requirement exists in the prior art. What is needed is a method and apparatus for creating a filter that has flexibility in corner frequency selection, and maintains the low current drain and high dynamic range performance of passive filters.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
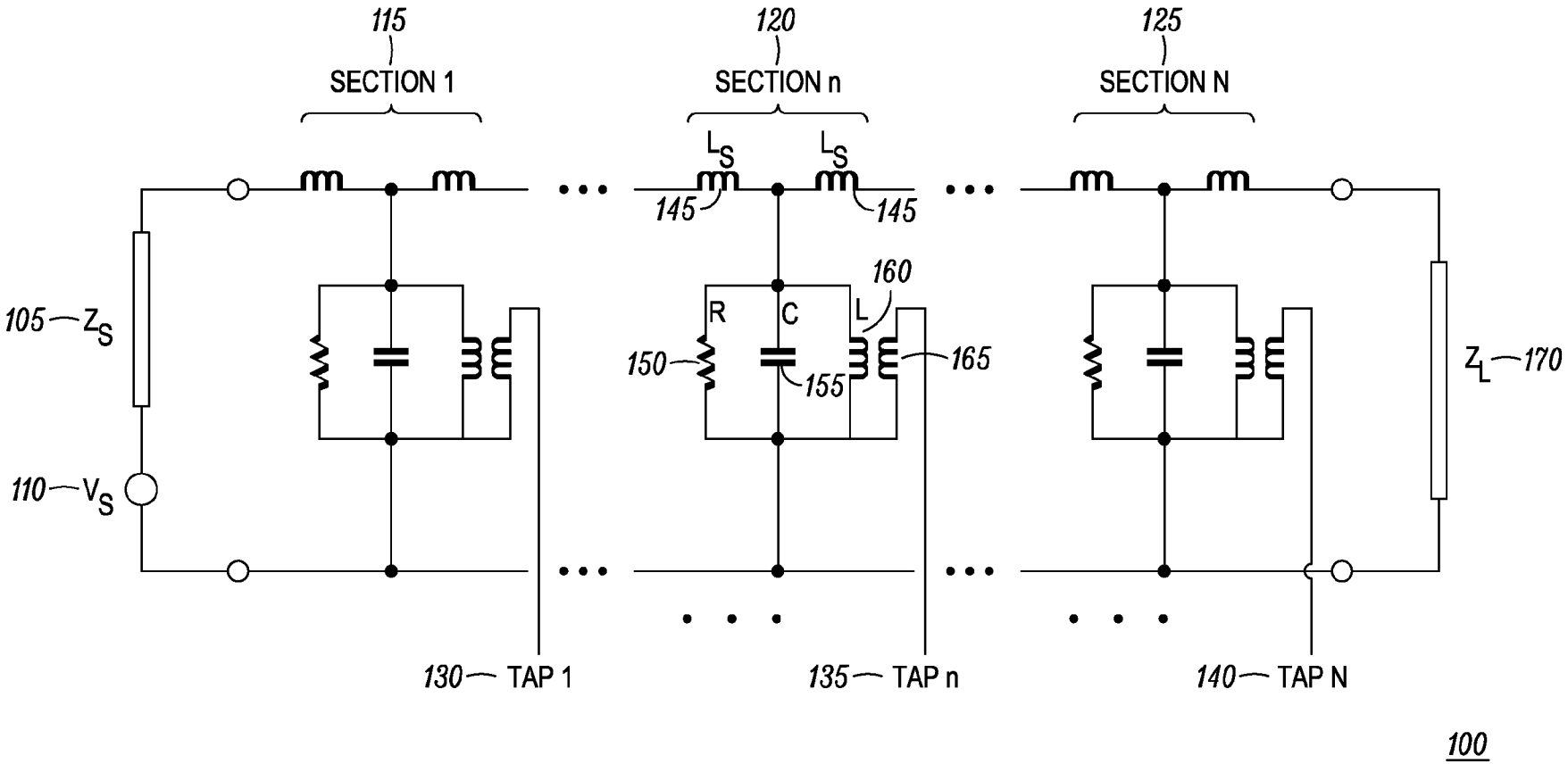
FIG. 1 is a generalized circuit schematic of a highpass filter, showing an implementation of output taps useful for selection of highpass corner frequency, utilized in accordance with certain embodiments of the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to the functions of the invention described herein. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

It will be appreciated that embodiments of the invention described herein may be comprised of one or more conventional processors and unique stored program instructions that control the one or more processors to implement, in conjunction with certain non-processor circuits, some, most, or all of the functions of the invention described herein. The non-processor circuits may include, but are not limited to, a radio receiver, a radio transmitter, signal drivers, clock circuits, power source circuits, and user input devices. As such, these functions may be interpreted as a method to perform the functions of the invention described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used. Thus, methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

Various filter implementations for providing enhanced performance when utilizing highpass, lowpass, bandpass, and bandstop filters in electronic applications are presented, in accordance with certain embodiments of the present invention.

Many variations, equivalents and permutations of these illustrative exemplary embodiments of the invention will occur to those skilled in the art upon consideration of the description that follows. The particular examples utilized should not be considered to define the scope of the invention. For example discrete circuitry implementations, integrated circuit implementations, and hybrid approaches thereof, may be formulated using techniques of the present invention.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals may be used to describe the same, similar or corresponding parts in the several views of the drawings.

The disclosed invention offers a method for obtaining true multi-band filter selectivity that can easily be controlled to be tunable in frequency. This invention offers an advantage to many communications products, including next generation platform multiband radios, in improving multi-band highpass selectivity out of a single structure, and is especially important for future generations of software-defined radios (SDRs) that require flexible, programmable filtering. This filtering is essential in controlling the width of spectrum to be processed by the radio and to block spurious responses (image and half-IF typically being the most troublesome). The disclosed filters can be used in both the receiver and transmitter sections of a radio. Up to date, no true simple wideband multiband RF selectivity scheme exists utilizing a single structure.

It is important to note that the filters of the present invention have no theoretical restrictions on frequencies of operation. They are however restricted by practical considerations, such as the ability to produce very large or very small stripline structures.

One embodiment of the present invention operates as a highpass filter capable of a plurality of outputs, each at a different corner frequency. Another embodiment of the present invention involves utilizing said highpass filter with a lowpass filter to produce a bandpass filter. A further embodiment of the present invention involves utilizing said highpass filter with a lowpass filter to produce a bandstop filter.

Refer to FIG. 1, which is a generalized circuit schematic 100 of a highpass filter, showing an implementation of output taps useful for selection of highpass corner frequency, utilized in accordance with certain embodiments of the present invention. Voltage source Vs 110 generates a sinusoidal test waveform of selectable amplitude and frequency. Source impedance Zs 105 establishes the source impedance for the filter that follows, and its characteristics depend on filter design parameters. The highpass filter is composed of cascaded sections, which are section 1 115 . . . section n 120 . . . section N 125. Each section is depicted as having two series inductors Ls 145, and a shunt arm connected at the midpoint of the two series inductors consisting of a parallel resonant structure resistor R 150, capacitor C 155, and inductor L 160. The number of filter sections needed is based upon filter design requirements. Any filter section may if required be outfitted with an output tap. These output taps are shown as tap 1 130, tap n 135, and tap N 140, for section 1 115, section n 120, and section N 125, respectively. The present invention does not require that all sections have an output tap. The present invention does envision output taps installed as required by filter design requirements, and an output tap may obtain an output signal through electric, magnetic, or electromagnetic coupling to one of the parallel resonant structures. An output tap is designed so that it electrically matches its tap load (not shown), commonly 50 ohms, to the filter impedance at the selected point. Note that the taps are shown as transformer coupled, but that other standard forms for impedance transformation may be employed in addition to or in place of transformer coupling, such as lumped LRC or microstripline impedance transforming circuitry. To produce the high-pass response of the present invention, the shunt arms are made to be parallel resonant (antiresonant) structures, the low frequency phase velocity is inversely proportional to the shunt arms' frequencies of resonance, and the frequencies of resonance of the shunt arms increase exponentially as one travels away from the input, with the damping factor (i.e. Q) of the shunt arms being constant. A preferred embodiment of this structure is formed using microstripline, in which the shunt arms (resonators) are stubs each one-quarter wavelength long, and grounded at the end distal to the transmission line. This produces a high impedance at the transmission line, emulating the antiresonant tank structures of FIG. 1. Note that an output signal may be obtained by any method of coupling to a resonator or resonators, such as by mechanical, electric, magnetic, and electromagnetic means.

Note that the structure of FIG. 1 differs in significant ways from that disclosed in known structures. In particular, the shunt arms disclosed in certain previous filters are series resonant structures, not the parallel resonant (antiresonant) structures of the present invention. Further, and contrary to the teachings of the prior art, in the present invention the frequencies of resonance of the shunt arms increase, rather than decrease, exponentially as one travels away from the input.

Figure 2:
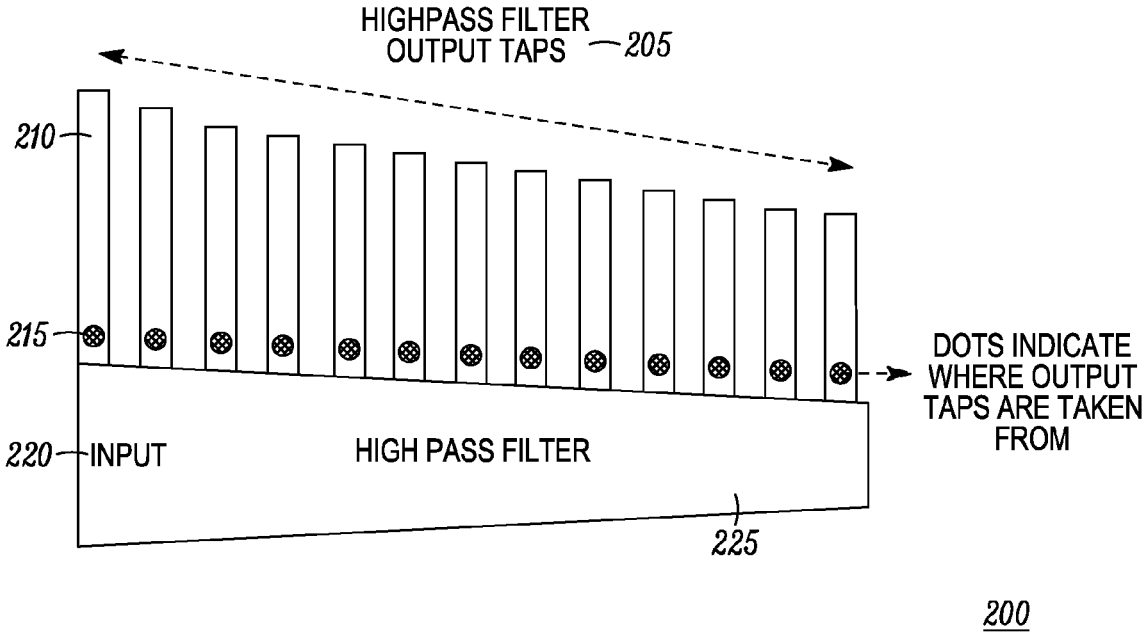
FIG. 2 is a graphical representation of a highpass filter structure implemented in microstripline and showing output taps useful for selection of highpass corner frequencies, utilized in accordance with certain embodiments of the present invention.

Refer to FIG. 2, which is a graphical representation 200 of a highpass filter structure implemented in microstripline and showing output taps useful for selection of highpass corner frequencies, utilized in accordance with certain embodiments of the present invention. The highpass filter 200 (constructed for experimental purposes) is approximately 3 inches in length, with signal input 220, and being composed of an exponentially tapered transmission line with multiple stubs 210 (resonators) of substantially constant damping factor (Q) attached to the main line structure. N stubs are shown, and each stub is grounded at its distal end (i.e., short-circuited). Each stub may contain an output tap 215, although output taps may be restricted to only selected stubs as defined by filter requirements. Alternatively, any output tap 215 may be located on the transmission line proximal to the stub (not shown). The set of all taps is highpass filter output taps 205. Each stub is shorter than its predecessor (the frequency of resonance is higher) by the same exponential proportion as the transmission line characteristic impedance increases. The characteristic impedance at a distal end of the transmission line divided by the characteristic impedance at the input is substantially equal to a desired upper operating frequency range limit divided by a desired lower operating frequency range limit. The length of the transmission line 225 is arbitrary. Each output tap is a highpass output, and successively shorter stub taps shift the corner frequency of the highpass output incrementally up in frequency.

A model of the above structure was simulated in the Advanced Design System simulator (Agilent Technologies, Palo Alto, Calif.) using microstripline with 42 resonators (an arbitrary number) attached to the transmission line. With 42 resonators, the structure can produce 42 outputs, each with a different corner frequency, taken at any particular point throughout the transmission line to cover, say, from about 100 MHz to approximately 1 GHz. (for this simulation). In a product implementation it is envisioned that many more resonators, spaced closer together, would be used. For this simulation, 12 output taps were utilized at the same time, each of them every 3 resonators apart along the structure. Scattering parameter data for these 12 outputs were utilized for analysis, and the resulting highpass responses occurred at predicted frequency points and a minimum of 70 dB of attenuation was achieved at 200 MHz and more below each corner frequency. Ripple in the passband can be controlled by accurate impedance matching at each output tap, and by increasing the number of resonators. The simulated insertion loss in the passband was found to be about 5 dB, but it is important to remember that this is achieved with all twelve loads connected at one time.

For ease of fabrication and test on the lab bench, the initial development of the disclosed invention was made using microstripline on alumina and Teflon printed circuit board material. However, nothing in the disclosed invention prevents implementations in more physically compact technologies, such as microelectromechanical systems (MEMS) resonators (e.g., Abdelmoneum, M. A.; Demirci, M. U.; and Nguyen, C. T.-C., "Stemless wine-glass-mode disk micromechanical resonators," IEEE Sixteenth Annual International Conference on Micro Electro Mechanical Systems, MEMS-03, Kyoto, 19-23 Jan. 2003, pp. 698-701), discrete integration on silicon, stripline on high-dielectric constant substrates, or other miniaturization methods known in the art. Note that, in the case of some physically compact technologies, such as MEMS resonator technology, an output tap (for example, tap n 135 in FIG. 1) may obtain an output signal through mechanical coupling to the transmission line, or to one of the parallel resonant structures. In general, an output signal may be obtained by any method of coupling to a resonator or resonators, including mechanical, electric, magnetic, and electromagnetic coupling.

Figure 3:
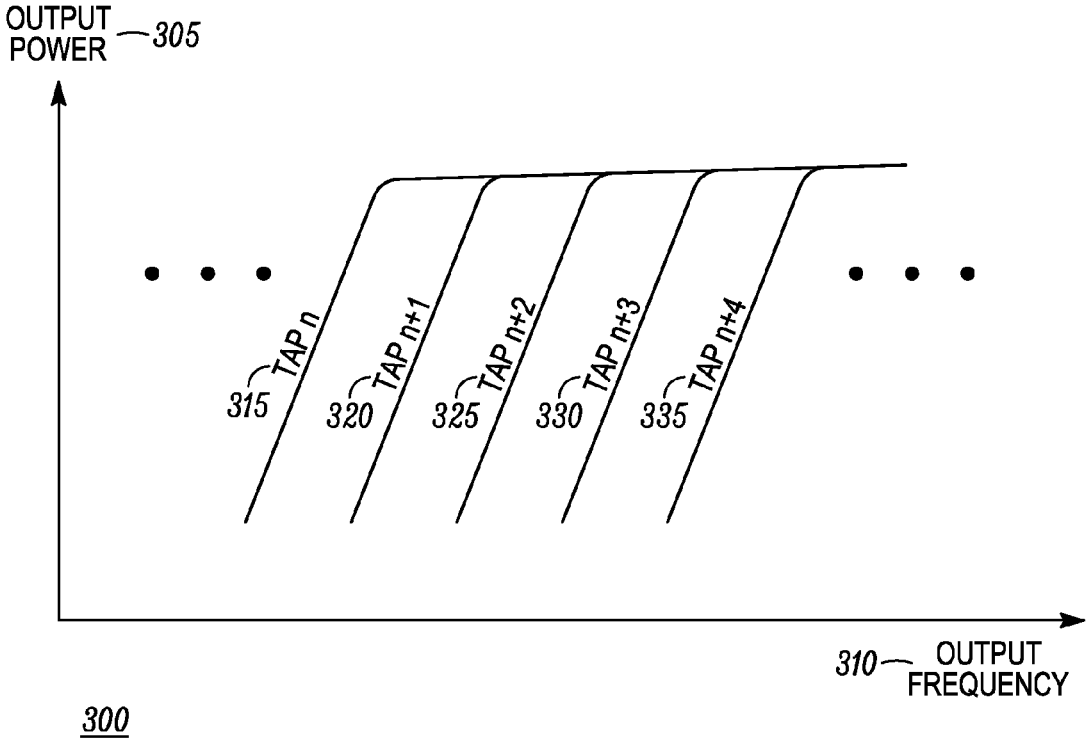
FIG. 3 is a family of plots of typical highpass filter responses obtained at successive output taps of a group of contiguous output taps, showing the successively increasing highpass corner frequencies that are available, utilized in accordance with certain embodiments of the present invention.

Refer to FIG. 3, which is a family of plots 300 of typical highpass filter responses obtained at successive output taps of a group of contiguous output taps, showing the successively increasing highpass corner frequencies that are available, utilized in accordance with certain embodiments of the present invention. A family of curves is shown which shows the nature of the highpass response change as adjacent output taps are selected. The vertical axis is output power 305, and the horizontal axis is frequency 310. Referring to the curve for tap n 315, it can be seen that a highpass response is shown. If the next tap up, tap n+1 320, is examined it will be seen that the highpass response curve is similar to the curve for tap n 315, but the corner frequency is higher. This trend continues for tap n+2 325, tap n+3 330, and tap N+4, with successively higher taps producing a similar highpass response at higher and higher corner frequencies. A selector device, not shown, such as a simple mechanical switch or switching circuitry, said circuitry being responsive to switch position selection or under software control, may be used to select any tap desired and output it. In this manner the highpass filter of the present invention provides a multiplicity of corner frequency selections simply under manual or software control.

As is known to those of ordinary skill in the art, highpass and lowpass filters may be coupled in various configurations to produce bandpass and bandstop filters. For example, the highpass filter of the present invention and a lowpass filter, such as that described in U.S. Pat. No. 6,768,398, may be coupled in series to produce a bandpass filter of great flexibility, since the low-frequency corner of the bandpass, determined by the highpass filter corner frequency, and the high-frequency corner of the bandpass, determined by the lowpass filter corner frequency, may be independently controlled. Additional exemplary bandpass filters may be constructed employing the present invention and other types of lowpass filters. Finally, a bandpass filter may be constructed by employing two highpass filters of the present invention, having different corner frequencies. In this embodiment, their inputs are placed in parallel, and output of the filter having the higher corner frequency is subtracted from the output of the other filter, producing a bandpass response. This embodiment is particularly advantageous for the highpass filter of the present invention, as the resulting bandpass filter again has great flexibility.

As an additional example, a bandstop filter may be constructed by employing a highpass filter of the present invention, and a lowpass filter. In this embodiment, the inputs of the two filters are placed in parallel, and outputs of the two filters are summed. If the corner frequency of the lowpass filter is lower than that of the highpass filter, a bandstop filter will result. This embodiment is particularly advantageous for the lowpass filter of the '398 patent and the highpass filter of the present invention, as the resulting bandstop filter again has great flexibility.

Figure 4:
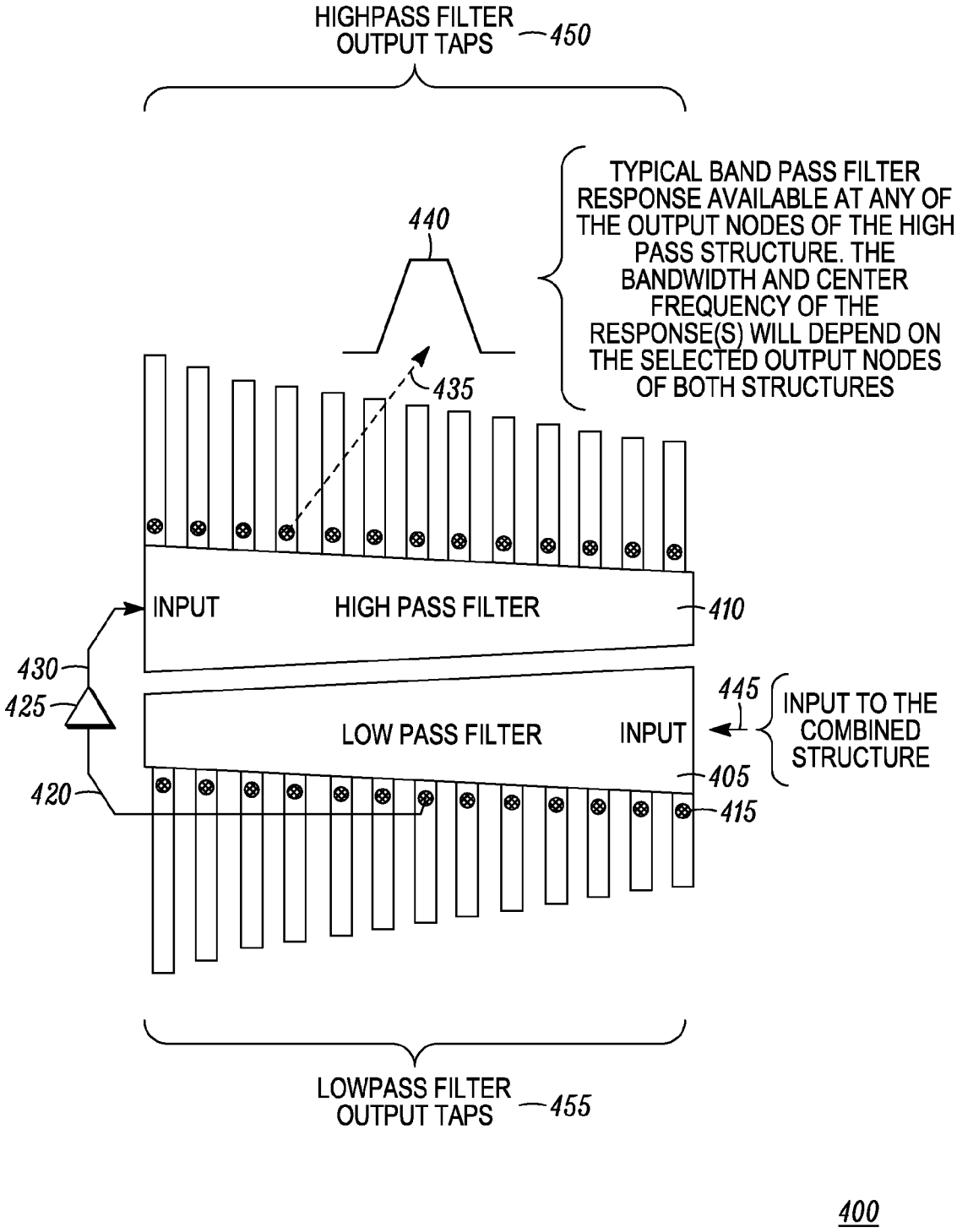
FIG. 4 is a graphical representation of a highpass filter structure configured with a lowpass filter structure to achieve an overall bandpass filter response, with both filters implemented in microstripline, and both filters having output taps which provide independent selection of the corner frequencies of the bandpass response, utilized in accordance with certain embodiments of the present invention.

Refer to FIG. 4, which is a graphical representation 400 of a highpass filter structure configured with a lowpass filter structure to achieve an overall bandpass filter response, with both filters implemented in microstripline, and both filters having output taps which provide independent selection of the corner frequencies of the bandpass response, utilized in accordance with certain embodiments of the present invention. By using a microstripline highpass filter, described above, and a microstripline lowpass filter from prior art, it is possible to tap at any particular resonator in both structures to produce bandpass responses (lowpass plus highpass equals bandpass, given that the lowpass corner frequency is higher than the highpass corner frequency). The input to combined filter 400 is Input 445, which is the input of transmission line 405. The lowpass microstripline structure contains a number of stubs, with desired stubs containing output taps 415, with available lowpass filter output taps 455. The lowpass filter output 420 is defined as the output of the selected lowpass output tap. Lowpass output 420 is routed to the input of isolation device 425. Isolation device 425 is designed to properly terminate the output of the lowpass filter, and to provide the proper source impedance for the input of the following highpass filter, and among others FET amplifiers, such as MOSFET or GaAs FET amplifiers, are suitable for this purpose. The output of isolation device 425 is routed to the input of highpass filter transmission line 410. The highpass filter contains a number of stubs and highpass filter output taps 450. These function in a manner as previously described. The output of the highpass filter is defined as the output of the selected highpass output tap. This combined filter 400 is tunable in both frequency and bandwidth. It is tunable in frequency by selecting output taps in the desired portion of the frequency range, for both lowpass and highpass filters, and it is tunable in bandwidth by varying the selection of highpass filter output taps 450 and lowpass filter output taps 455. The combined filter 400 will retain phase information that would be lost if other schemes to obtain bandpass responses were utilized. Selecting one tap from each structure will produce a bandpass output. Varying tap selections in either or both structures incrementally will vary bandwidth, and varying tap selections significantly for both structures will move the frequency of operation. The present invention offers a method for obtaining true multiband selectivity that can be fully controlled to be tunable in frequency and bandwidth. It is to be noted that the order of the highpass and lowpass filters may be interchanged, that is the highpass filter may be placed first in the cascade and the lowpass filter placed second, and the performance will be equivalent.

Figure 5:
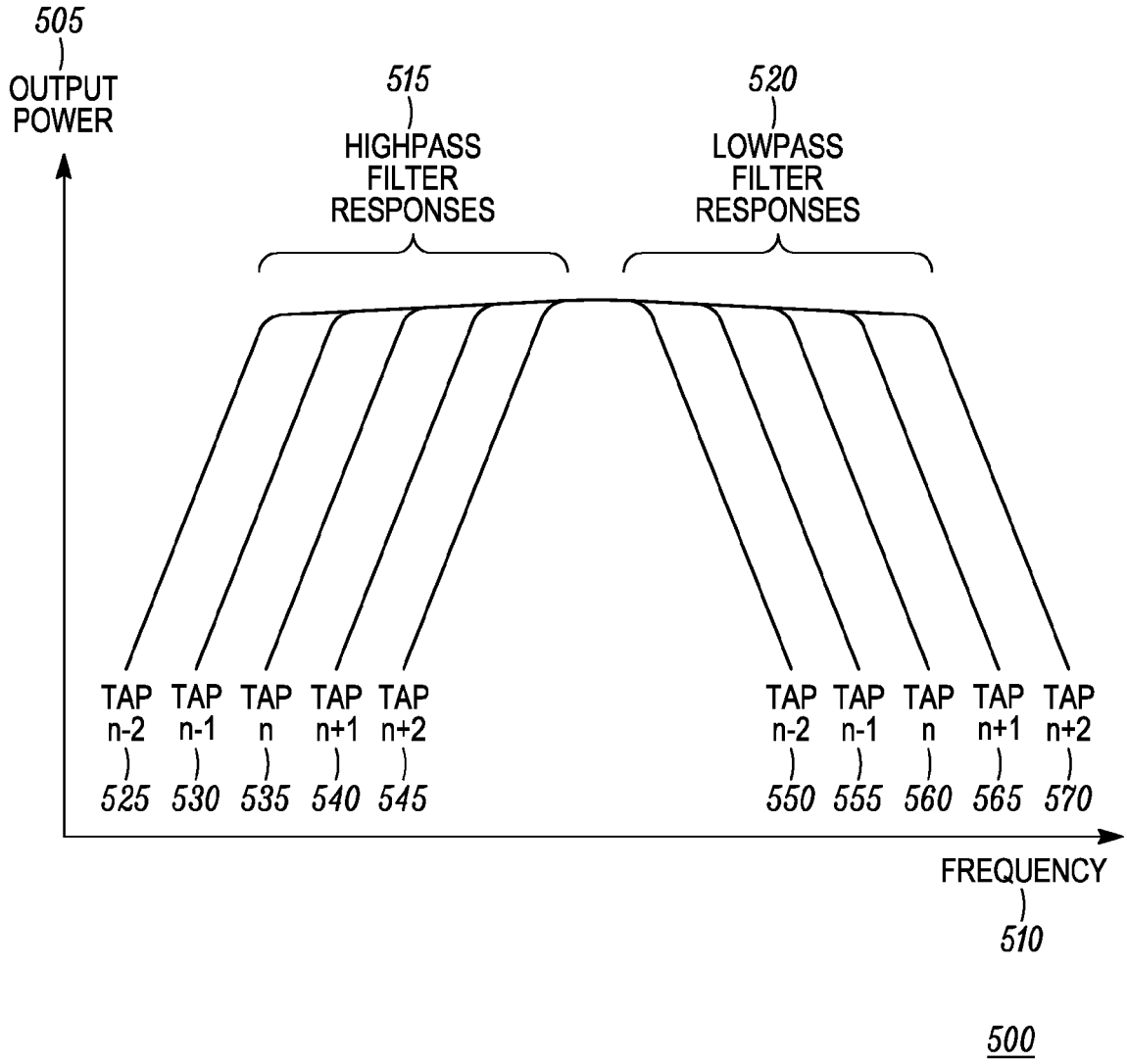
FIG. 5 is a family of plots of typical bandpass filter responses obtained by using successive output taps of a group of contiguous output taps of cascaded highpass and lowpass filters, utilized in accordance with certain embodiments of the present invention.

Refer to FIG. 5, which is a family of plots of typical bandpass filter responses obtained by using successive output taps of a group of contiguous output taps of cascaded highpass and lowpass filters, utilized in accordance with certain embodiments of the present invention. The vertical axis is output power 505, and the horizontal axis is frequency 510. A family of curves is presented for a bandpass response. On the left, highpass filter responses 515 are shown, and on the right lowpass filter responses 520 are presented. Highpass filter responses 515 were generated by selecting five sequential highpass filter output taps sequentially and plotting each corresponding response. Tap n−2 525 produces the lowest highpass corner frequency, and tap n+2 545 produces the highest highpass corner frequency, with tap n−1 530, tap n 535, and tap n+1 540 providing interim highpass corner frequencies. Lowpass filter responses 520 were generated by selecting five sequential lowpass filter output taps sequentially and plotting each corresponding response. Tap n−2 550 produces the lowest lowpass corner frequency, and tap n+2 570 produces the highest lowpass corner frequency, with tap n−1 555, tap n 560, and tap n+1 565 providing interim lowpass corner frequencies. Selector devices, not shown, such as simple mechanical switches or switching circuitries, said circuitries being responsive to switch position selection or under software control, could be used to select any tap desired from the highpass filter and from the lowpass filter. In this manner the bandpass filter of the present invention could provide a multiplicity of frequency and bandwidth selections simply under manual or software control.

Figure 6:
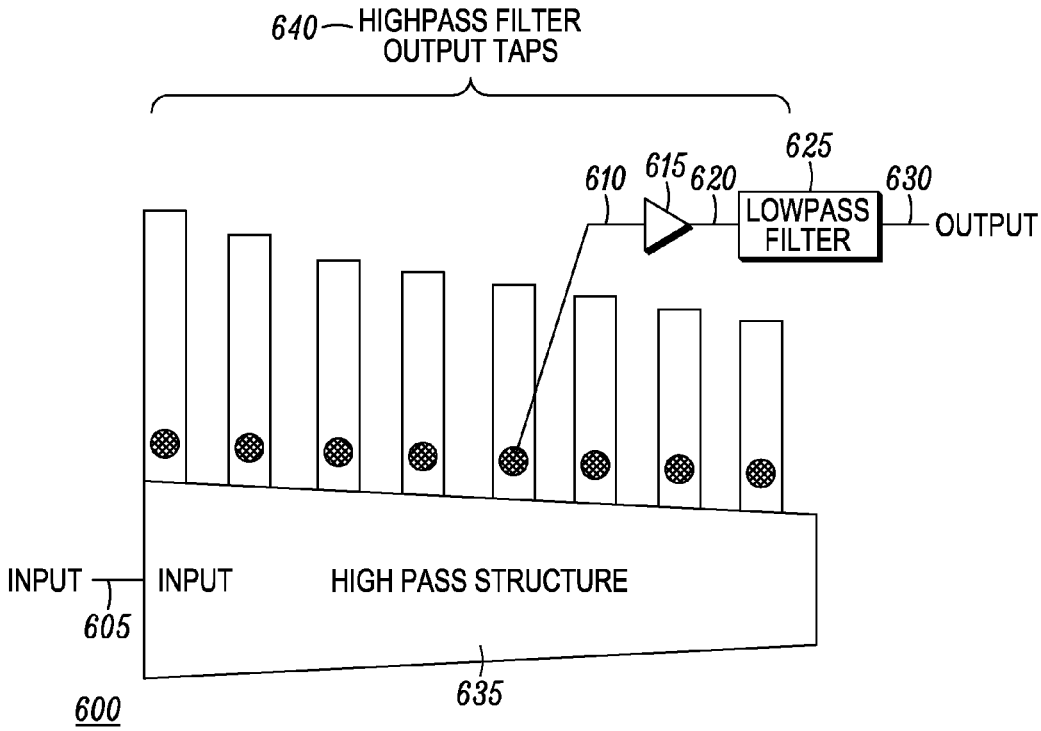
FIG. 6 is an exemplary block diagram of a highpass filter structure with multiple output taps, configured with a lowpass filter, to achieve a bandpass filter response, showing highpass filter output taps useful for independent selection of lower corner frequencies of the bandpass response, utilized in accordance with certain embodiments of the present invention.

Refer to FIG. 6, which is an exemplary block diagram 600 of a highpass filter structure with multiple output taps, configured with a lowpass filter, to achieve a bandpass filter response, showing highpass filter output taps useful for independent selection of lower corner frequencies of the bandpass response, utilized in accordance with certain embodiments of the present invention. A highpass filter structure with transmission line 635, combined filter input 605, highpass filter output taps 640, and selected output tap 610, is shown. Selected output tap 610 is routed to the input of isolation device 615. Isolation device 615 is designed to provide the proper terminating impedance for selected output tap 610, and to provide the proper source impedance for lowpass filter 625. Isolation device output 620 is routed to the input of lowpass filter 625, and lowpass filter output 630 is the output of the combined filter. Lowpass filter 625 may be any kind of lowpass filter that provides the desired lowpass response, such as lumped element, laboratory test equipment, microstripline, active filter, hybrid filter, and others. The highpass filter is of the type previously described. This combined filter will have a bandpass response, with the upper corner frequency fixed by the lowpass filter, and a variable lower corner frequency which is determined by the highpass filter output tap selected. In this case the upper frequency of operation is set by the lowpass filter corner frequency.

Figure 7:
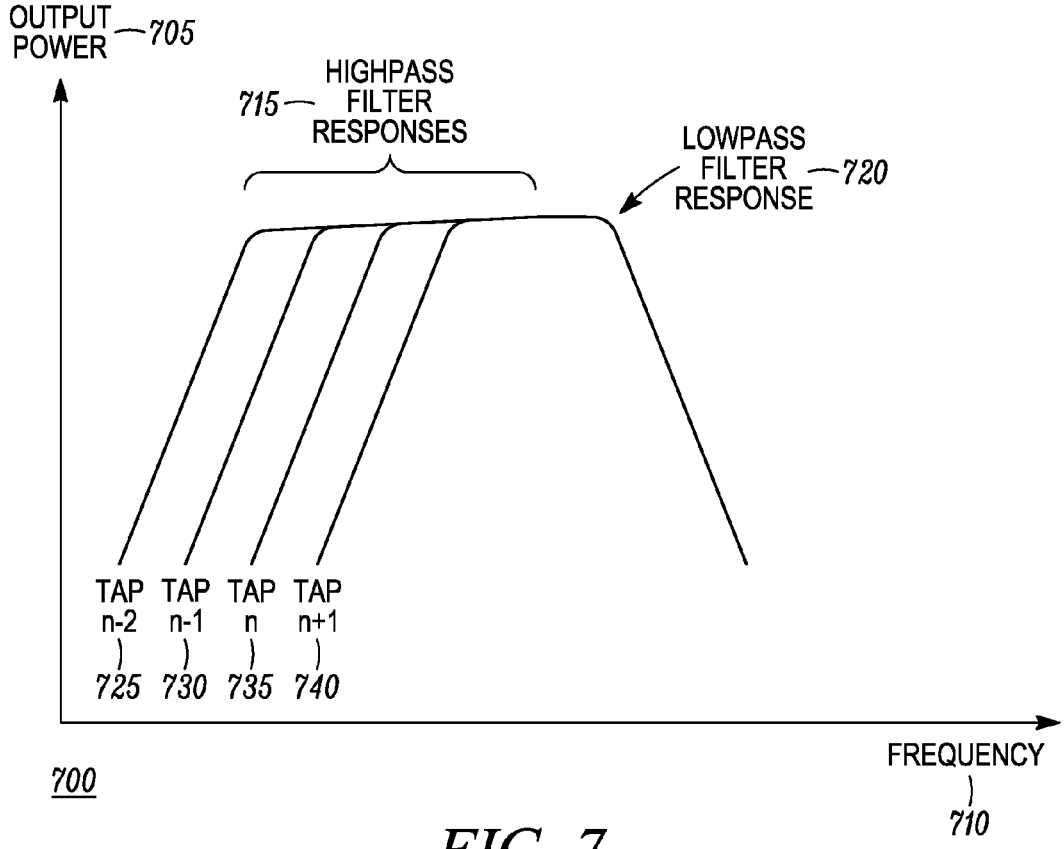
FIG. 7 is a family of plots of typical bandpass filter responses obtained by using successive output taps of a group of contiguous output taps of the highpass filter, configured with a lowpass filter, utilized in accordance with certain embodiments of the present invention.

Refer to FIG. 7, which is a family of plots 700 of typical bandpass filter responses obtained by using successive output taps of a group of contiguous output taps of the highpass filter, configured with a lowpass filter, utilized in accordance with certain embodiments of the present invention. The vertical axis is output power 705, and the horizontal axis is frequency 710. The fixed lowpass filter corner frequency is lowpass filter response 720. The various curves of highpass filter responses 715 represent the successive choice of highpass output taps. Tap n−2 725 provides the lowest highpass corner frequency, and tap n+1 740 provides the highest highpass corner frequency. Intermediate taps tap n−1 730 and tap n 735 are included to illustrate the incremental nature of output tap selection. A selector device, not shown, such as a simple mechanical switch or switching circuitry, said circuitry being responsive to switch position selection or under software control, could be used to select any tap desired from the highpass filter, In this manner the composite bandpass filter of the present invention could provide a multiplicity of bandwidth selections simply under manual or software control.

Figure 8:
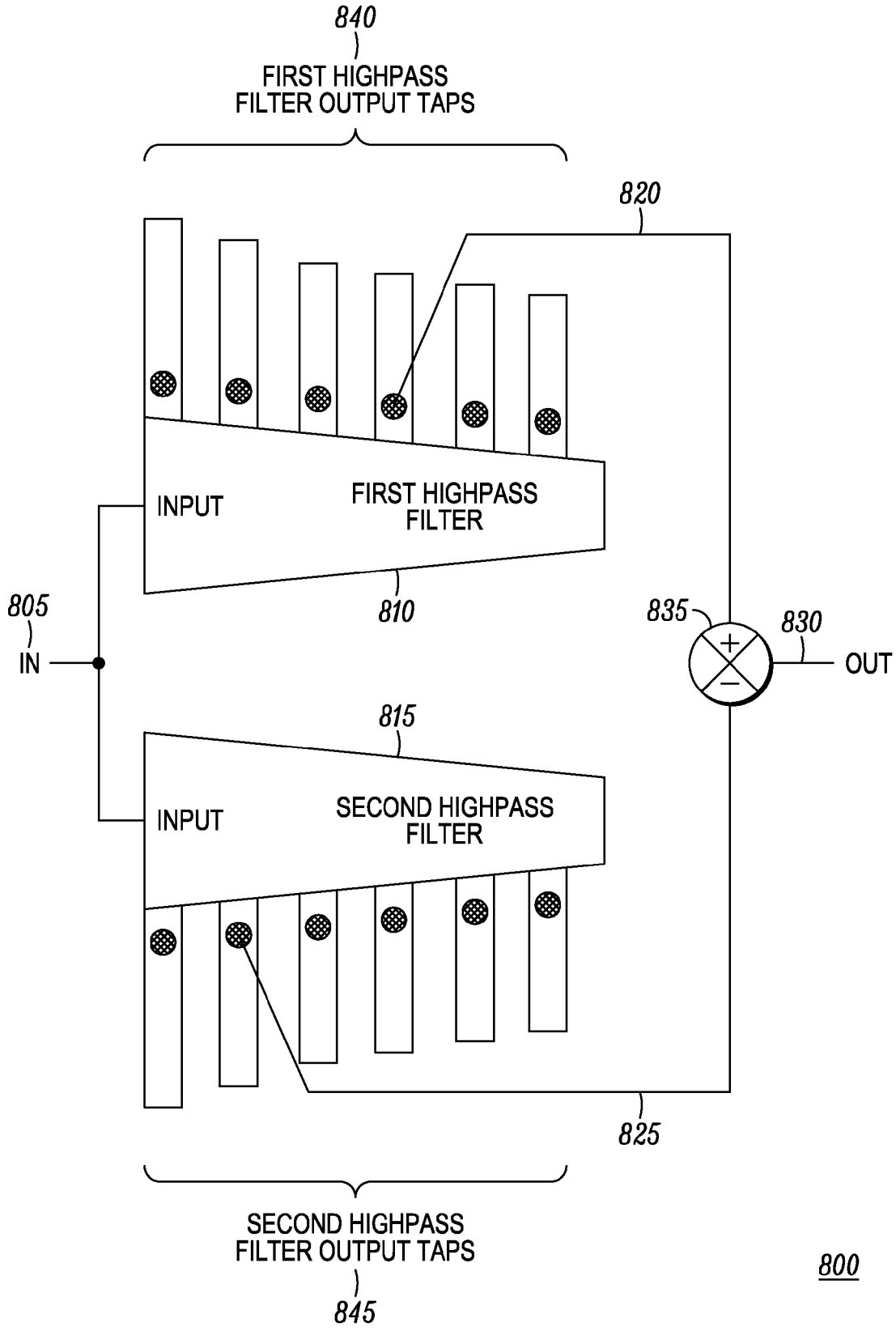
FIG. 8 is an exemplary block diagram of two highpass filter structures each having multiple output taps, configured to achieve a bandpass filter response, showing highpass filter output taps useful for independent selection of both corner frequencies of the bandpass response, utilized in accordance with certain embodiments of the present invention.

Refer to FIG. 8, which is an exemplary block diagram of two highpass filter structures each having multiple output taps, configured to achieve a bandpass filter response, showing highpass filter output taps useful for independent selection of both corner frequencies of the bandpass response, utilized in accordance with certain embodiments of the present invention. Combined filter input 805 routes the input to the transmission line 810 input of the first highpass filter and to the transmission line 815 input of the second highpass filter. A combiner (not shown) may be utilized to split combined filter input 805 into isolated paths as required for proper impedance matching to the aforementioned inputs. First highpass filter output taps 840 allow selection of the corner frequency of the first highpass filter, and second highpass tilter output taps 845 allow selection of the corner frequency of the second highpass filter. Selected second highpass filter output tap 835 is subtracted from selected first highpass filter output tap 820 in combiner 835. Combiner 835 may consist of any circuit or device or technique which functionally provides the combined difference between selected output tap 820 and selected output tap 825. The output of the combiner is combined filter output 830. Note that if the first highpass filter is configured for the lowest corner frequency, there will be no phase inversion of the bandpass signal. Selecting various output taps for the first highpass filter and the second highpass filter will change the bandwidth, in a manner similar to that described previously.

Figure 9:
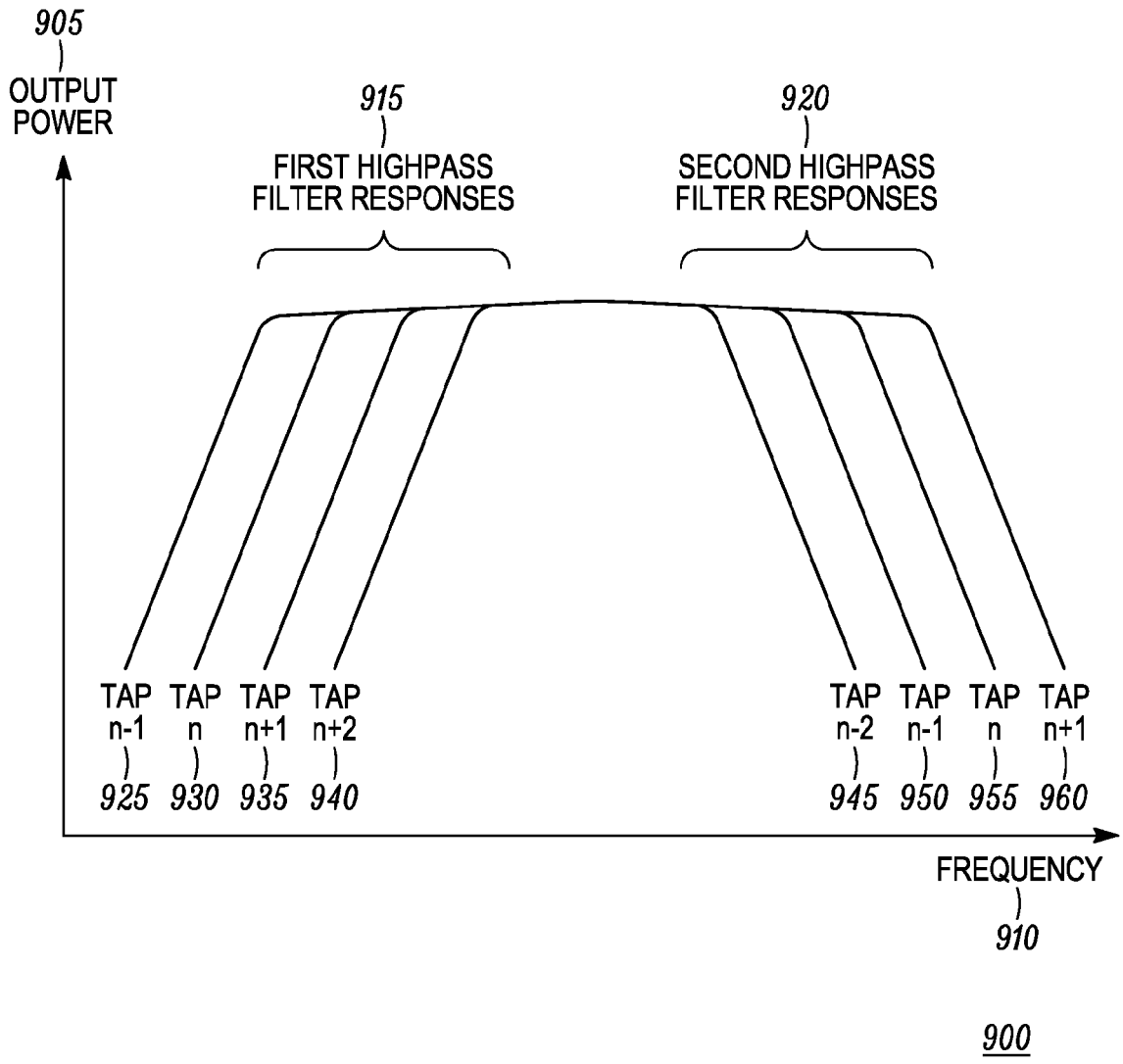
FIG. 9 is a family of plots of typical bandpass filter responses obtained by using successive output taps of a group of contiguous output taps of two separate highpass filters, configured to achieve a bandpass filter response, utilized in accordance with certain embodiments of the present invention.

Refer to FIG. 9, which is a family of plots 900 of typical bandpass filter responses obtained by using successive output taps of a group of contiguous output taps of two separate highpass filters, configured to achieve a bandpass filter response, utilized in accordance with certain embodiments of the present invention. The vertical axis is output power 905, and the horizontal axis is frequency 910. The family of curves to the left are first highpass filter responses 915, and the family of curves to the right are produced by the subtraction of second highpass filter responses 920. Tap n−1 925 provides the lowest corner frequency for the first highpass filter, and tap n+2 940 provides the highest corner frequency for the first highpass filter, and tap n 930 and tap n+1 935 provide intermediate corner frequencies for the first highpass filter. Tap n−2 945 provides the lowest corner frequency for the second highpass filter, and tap n+1 960 provides the highest corner frequency for the second highpass filter, and tap n−1 950 and tap n 955 provide intermediate corner frequencies for the second highpass filter. Note that the curves for the second highpass filter appear as lowpass responses because they are subtracted in combiner 835. The lower corner frequency of the bandpass is determined by the first highpass filter output tap selected, and similarly the upper corner frequency of the bandpass is determined by the second highpass tap selected. There is thus independent control over the upper and lower frequencies of the bandpass response. A selector device, not shown, such as a simple mechanical switch or switching circuitry, said circuitry being responsive to switch position selection or under software control, could be used to select any tap desired from the first highpass filter, and in a similar manner select any tap desired from the second highpass filter. In this manner the composite bandpass filter of the present invention could provide a multiplicity of bandwidth selections simply under manual or software control. This multiplicity of bandwidth selections could be achieved using independent bandpass corner frequency selections, or bandwidth selection could be implemented by a preset relationship between first highpass output tap and second highpass output tap, so that both are modified simultaneously to provide a given required bandwidth.

Figure 10:
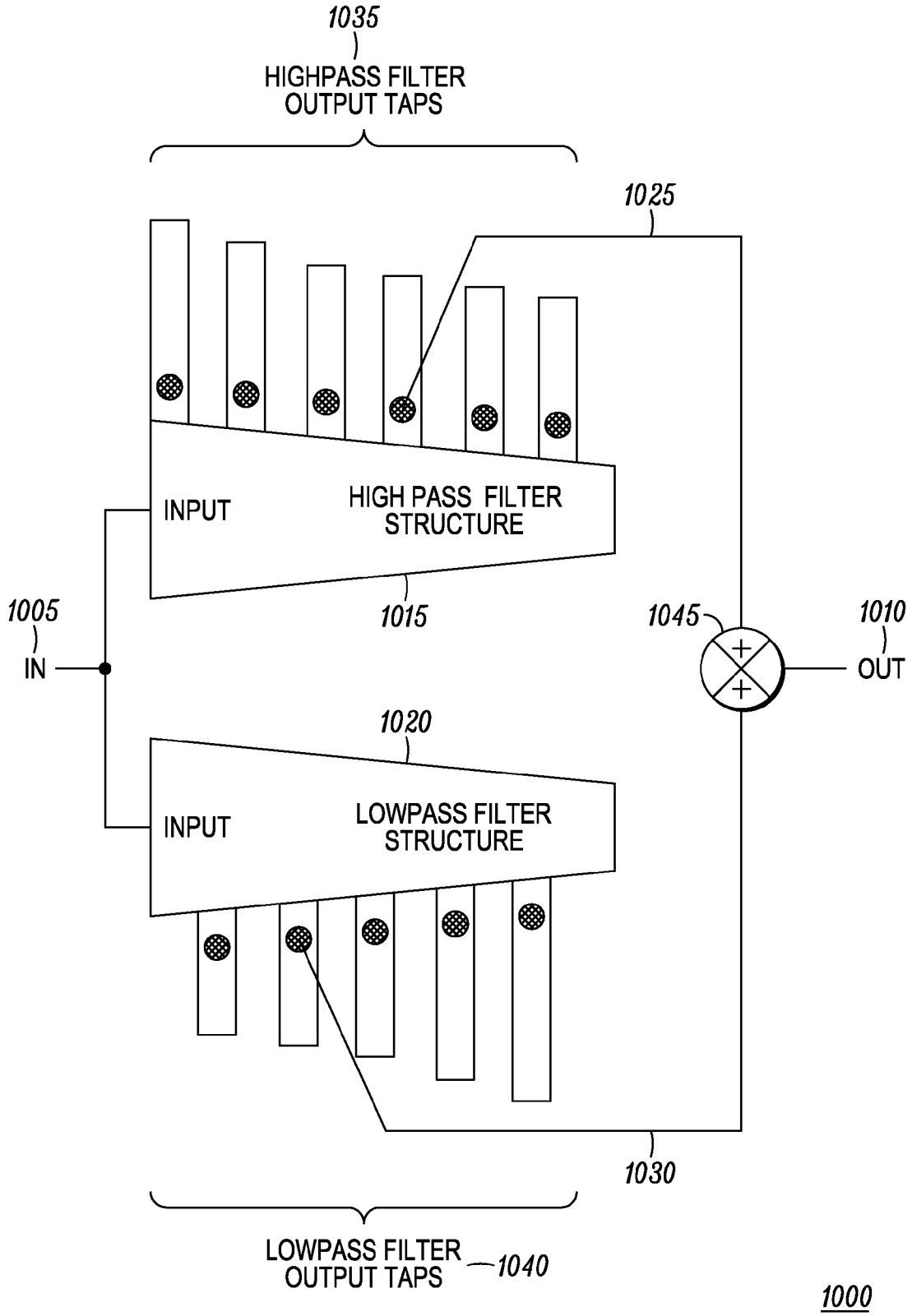
FIG. 10 is a graphical representation of a highpass filter structure configured with a lowpass filter structure to achieve a bandstop filter response, with both implemented in microstripline, and showing output taps useful for independent selection of the corner frequencies of the bandpass response, utilized in accordance with certain embodiments of the present invention.

Refer to FIG. 10, which is a graphical representation 1000 of a highpass filter structure configured with a lowpass filter structure to achieve a bandstop filter response, with both implemented in microstripline, and showing output taps useful for independent selection of the corner frequencies of the bandpass response, utilized in accordance with certain embodiments of the present invention. Combined filter input 1005 routes the input to the transmission line 1015 input of the highpass filter and to the transmission line 1020 input of the lowpass filter. A combiner (not shown) may be utilized to split combined filter input 1005 into isolated paths as required for proper impedance matching to the aforementioned inputs. Highpass filter output taps 1035 allow selection of the corner frequency of the highpass filter, and lowpass filter output taps 1040 allow selection of the corner frequency of the lowpass filter. Selected highpass filter output tap 1025 is added to selected lowpass filter output tap 1030 in combiner 1045. Combiner 1045 may consist of any circuit or device or technique which functionally provides the combined sum of selected highpass output tap 1025 and selected lowpass output tap 1030. The output of the combiner is combined filter output 1010. Note that the lowpass filter should be configured for the lowest corner frequency. Note that there is no phase inversion of the bandstop filter signal. Selecting various output taps for the highpass filter and the lowpass filter will change the bandwidth, in a manner similar to that described previously.

Figure 11:
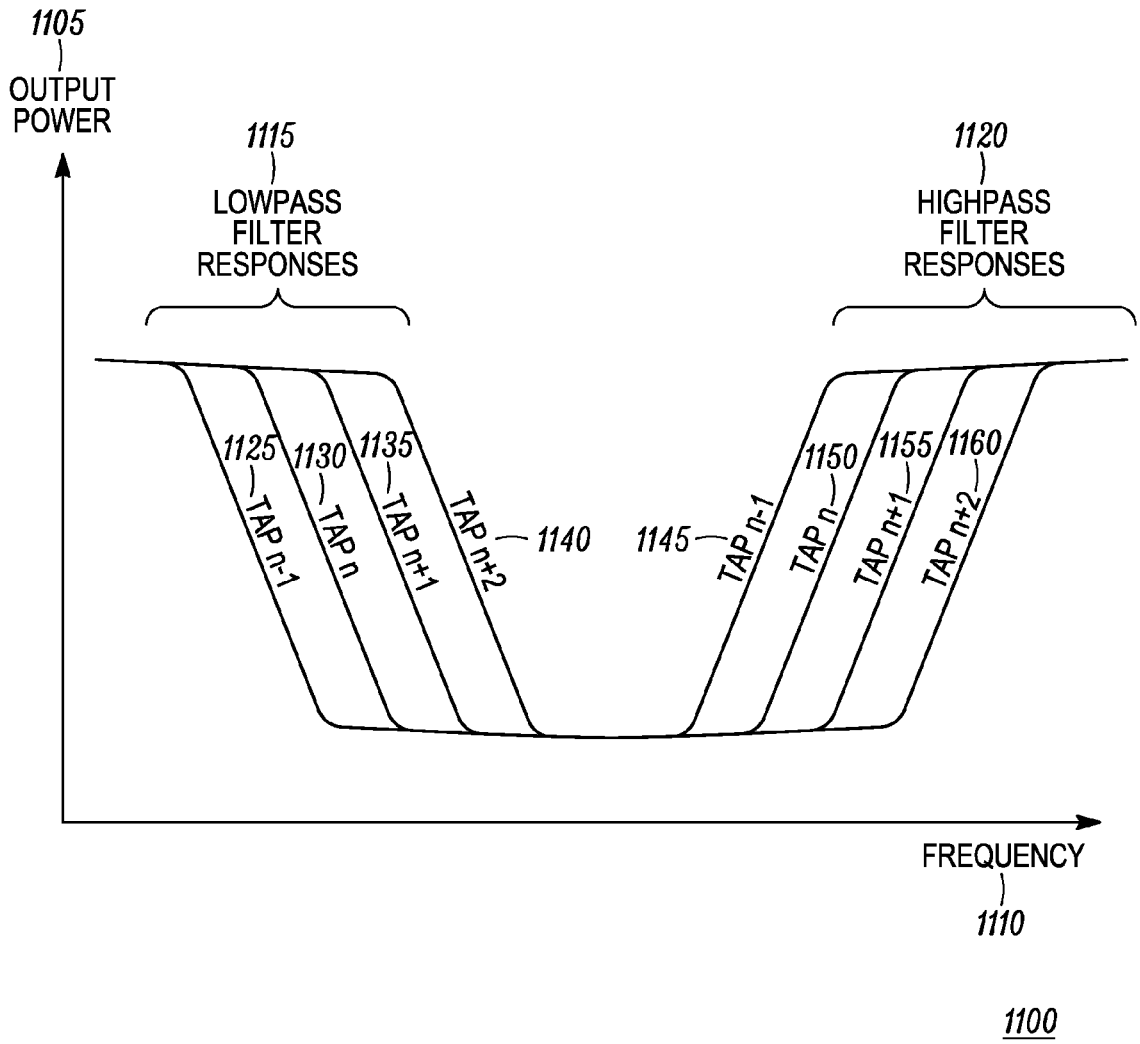
FIG. 11 is a family of plots of typical bandstop filter responses obtained by using successive output taps of a group of contiguous output taps of highpass and lowpass filter structures, configured to achieve a bandstop filter structure, utilized in accordance with certain embodiments of the present invention.

Refer to FIG. 11, which is a family of plots 1100 of typical bandstop filter responses obtained by using successive output taps of a group of contiguous output taps of highpass and of lowpass filter structures, configured to achieve a bandstop filter structure, utilized in accordance with certain embodiments of the present invention. The vertical axis is output power 1105, and the horizontal axis is frequency 1110. The family of curves to the left are lowpass filter responses 1115, and the family of curves to the right are produced by the addition of highpass filter responses 1120. Tap n−1 1125 provides the lowest corner frequency for the lowpass filter, and tap n+2 1140 provides the highest corner frequency for the lowpass filter. Tap n 1130 and tap n+1 1135 provide intermediate corner frequencies for the lowpass filter. Tap n−1 1145 provides the lowest corner frequency for the highpass filter, and tap n+2 1160 provides the highest corner frequency for the highpass filter. Tap n 1150 and tap n+1 1155 provide intermediate corner frequencies for the highpass filter. The lower corner frequency of the bandstop is determined by the lowpass filter output tap selected, and similarly the upper corner frequency of the bandstop is determined by the highpass tap selected. There is thus independent control over the upper and lower corner frequencies of the bandstop response. A selector device, not shown, such as a simple mechanical switch or switching circuitry, said circuitry being responsive to switch position selection or under software control, could be used to select any tap desired from the highpass filter, and in a similar manner select any tap desired from the lowpass filter. In this manner the composite bandstop filter of the present invention could provide a multiplicity of bandwidth selections simply under manual or software control. This multiplicity of bandwidth selections could be achieved using independent bandstop corner frequency selections, or bandwidth selection could be implemented by a preset relationship between highpass output taps and lowpass output taps, so that both are modified simultaneously to provide a given required bandwidth.

Figure 12:
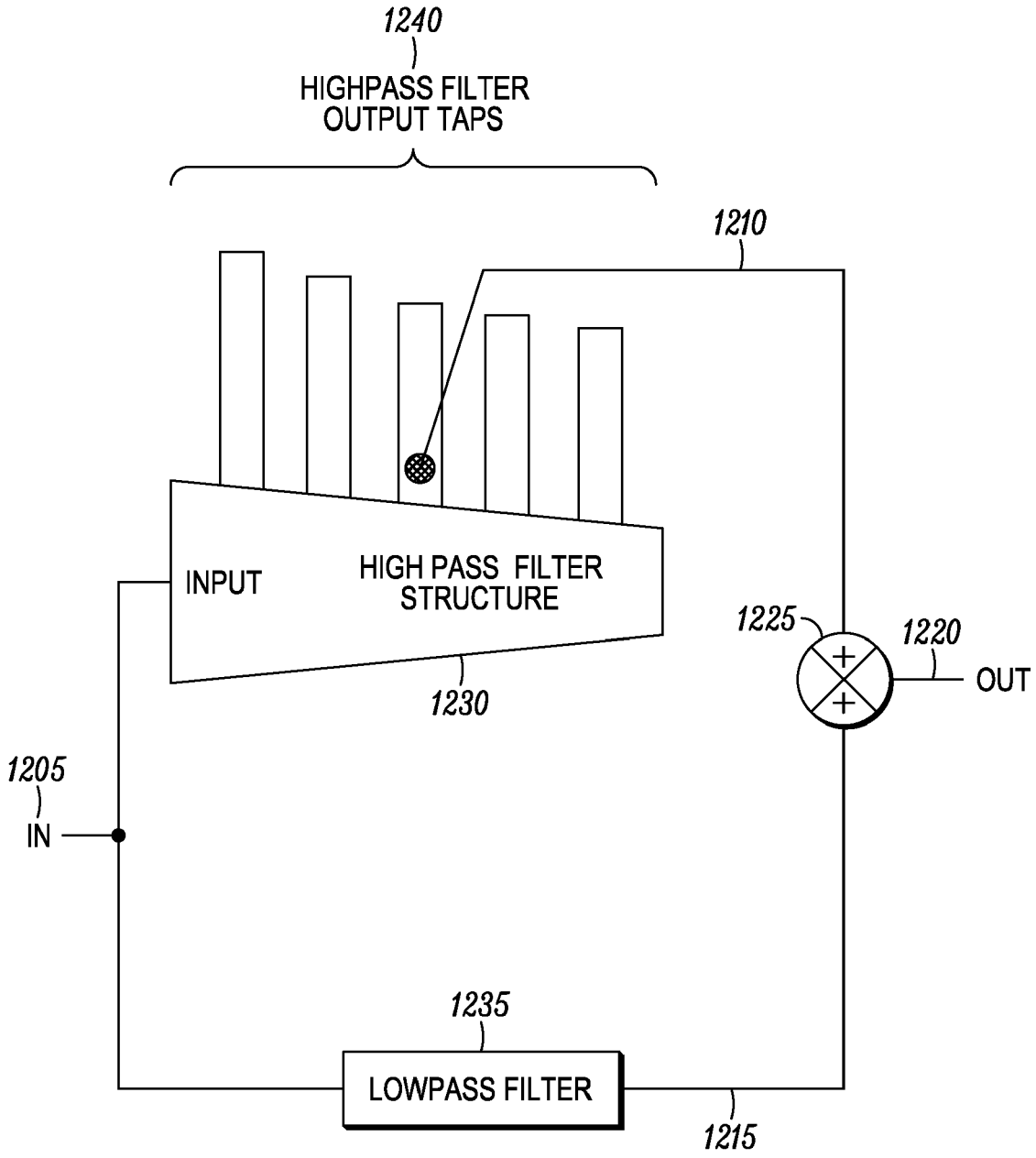
FIG. 12 is a graphical representation of a highpass filter structure combined with a lowpass filter to achieve bandstop filter responses, and showing output taps useful for independent selection of the upper corner frequency of the bandstop response, utilized in accordance with certain embodiments of the present invention.

Refer to FIG. 12, which is a graphical representation 1200 of a highpass filter structure combined with a lowpass filter to achieve bandstop filter responses, and showing output taps useful for independent selection of the upper corner frequency of the bandstop response, utilized in accordance with certain embodiments of the present invention. Combined filter input 1205 routes the input to the transmission line 1230 input of the highpass filter structure and to the input of the lowpass filter 1235. A combiner (not shown) may be utilized to split combined filter input 1205 into isolated paths as required for proper impedance matching to the aforementioned inputs. Highpass filter output taps 1240 allow selection of the corner frequency of the highpass filter. Selected highpass filter output tap 1210 is added to lowpass filter output 1215 in combiner 1225. Combiner 1225 may consist of any circuit or device or technique which functionally provides the combined sum of selected highpass output tap 1210 and lowpass filter output 1215. The output of the combiner is combined filter output 1220. Note that the lowpass filter should be configured for the lower corner frequency. Note that there is no phase inversion of the bandstop filter signal. Selecting various output taps for the highpass filter will change the bandwidth, in a manner similar to that described previously.

Figure 13:
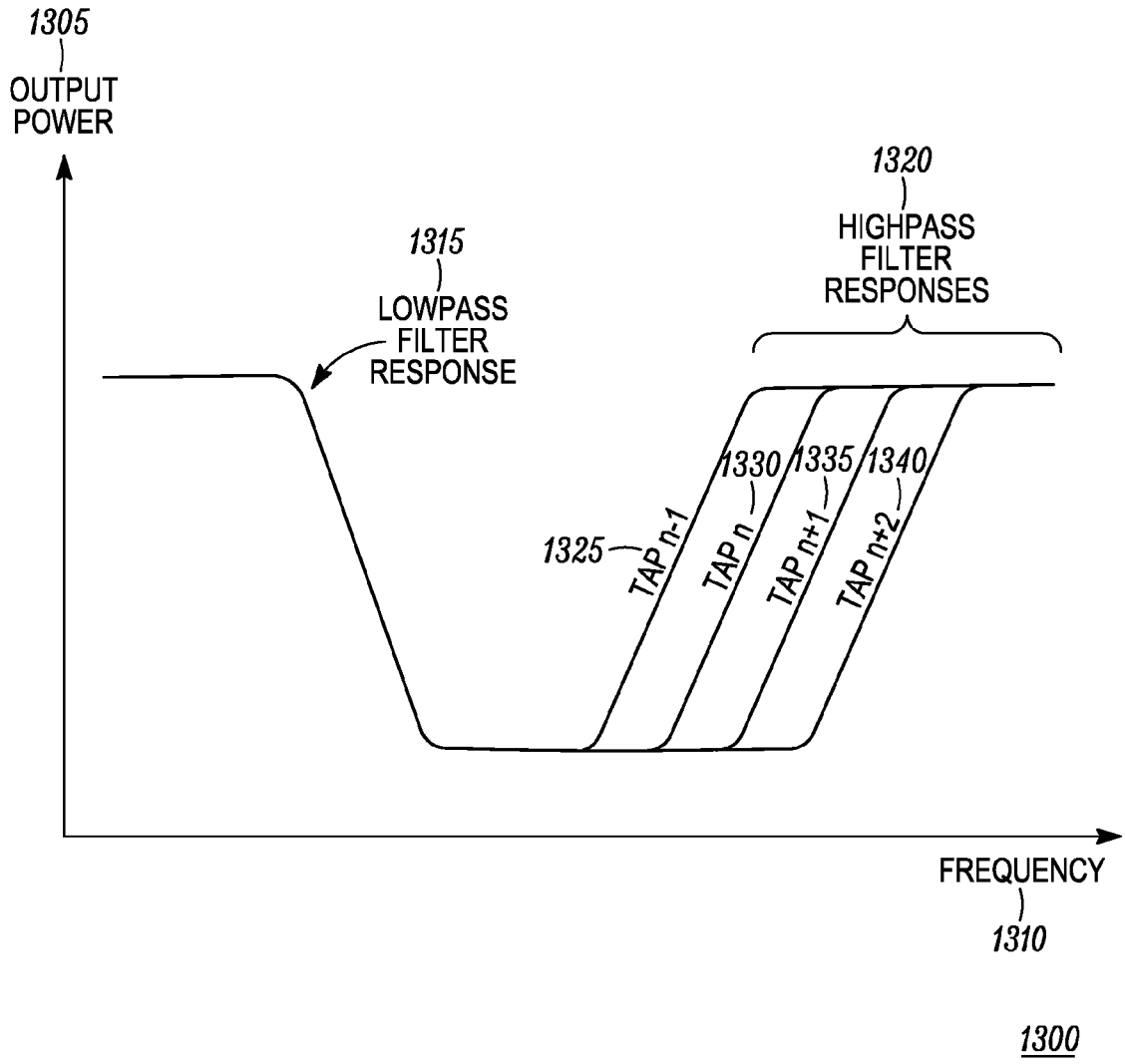
FIG. 13 is a family of plots of typical bandstop filter responses obtained by using successive output taps of a group of contiguous output taps of a highpass filter structure, configured with a lowpass filter to achieve a bandstop filter response, utilized in accordance with certain embodiments of the present invention.

Refer to FIG. 13, which is a family of plots 1300 of typical bandstop filter responses obtained by using successive output taps of a group of contiguous output taps of a highpass filter structure, configured with a lowpass filter, to achieve a bandstop filter response, utilized in accordance with certain embodiments of the present invention. The vertical axis is output power 1305, and the horizontal axis is frequency 1310. The curve to the left is the lowpass filter responses 1315, and the family of curves to the right are produced by the addition of highpass filter responses 1320. Tap n−1 1325 provides the lowest corner frequency for the highpass filter, and tap n+2 1340 provides the highest corner frequency for the highpass filter. Tap n 1330 and tap n+1 1335 provide intermediate corner frequencies for the highpass filter. The lower corner frequency of the bandstop filter is determined by the lowpass filter corner frequency, and the upper corner frequency of the bandstop is determined by the highpass tap selected. There is thus independent control over the upper and lower corner frequencies of the bandstop response. A selector device, not shown, such as a simple mechanical switch or switching circuitry, said circuitry being responsive to switch position selection or under software control, could be used to select any tap desired from the highpass filter. In this manner the composite bandstop filter of the present invention could provide a multiplicity of bandwidth selections simply under manual or software control.

Figure 14:
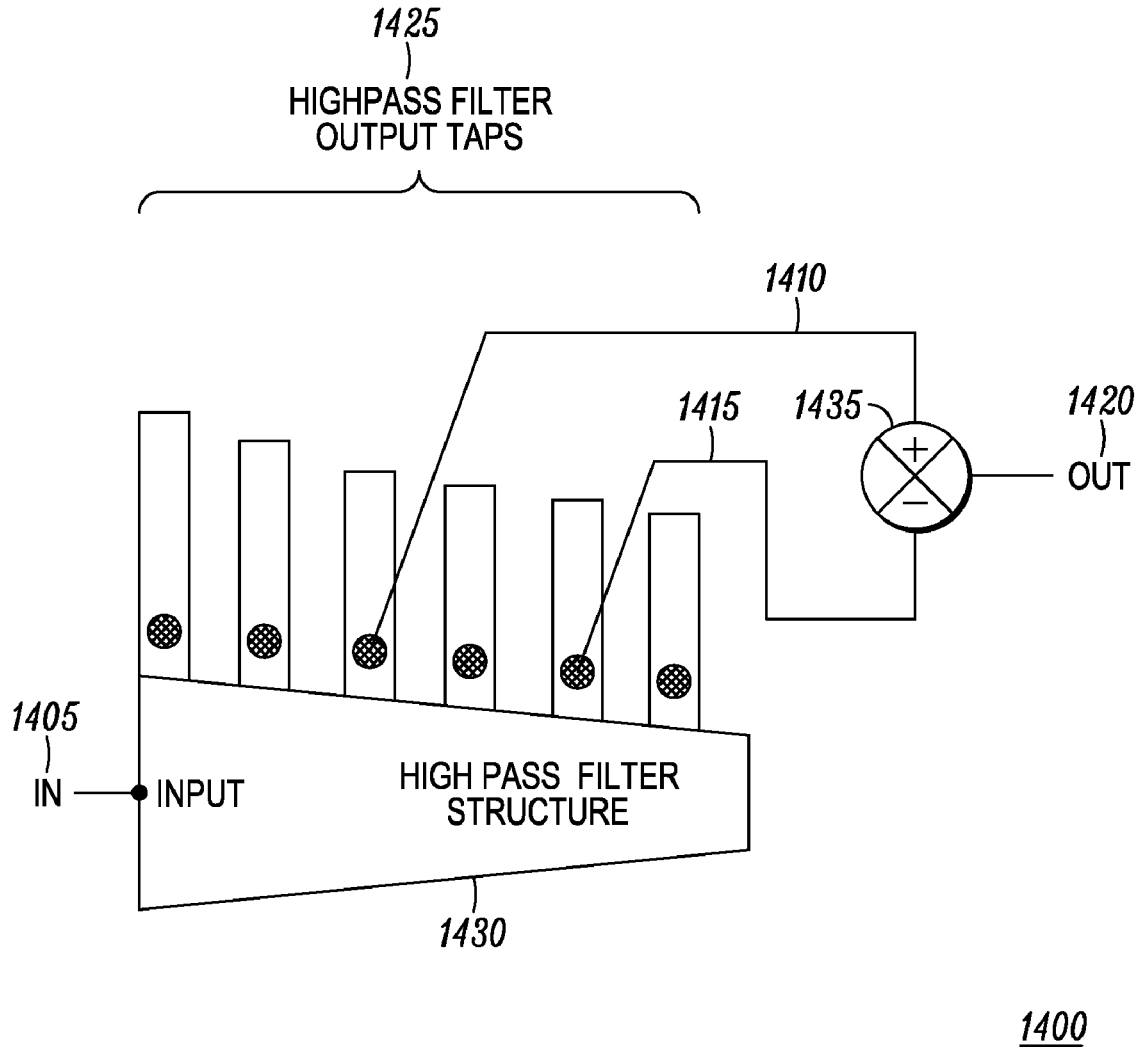
FIG. 14 is a graphical representation of a single highpass filter structure which achieves a bandpass filter response by utilizing two output taps, utilized in accordance with certain embodiments of the present invention.

Refer to FIG. 14, which is a graphical representation 1400 of a single highpass filter structure which achieves a bandpass filter response by utilizing two output taps, in accordance with certain embodiments of the present invention. Highpass filter input 1405 routes the input to the transmission line 1430 input of the highpass filter. An isolator (not shown) may be utilized to condition highpass filter input 1405 as required for proper impedance matching to the highpass filter input. Highpass filter output taps 1425 allow selections of the corner frequency of the highpass filter structure. Selected highpass filter output taps 1410 and 1415 are routed to the inputs of combiner 1435. Combiner 1435 subtracts tap output 1415 from tap output 1410. Combiner 1435 may consist of any circuit or device or technique which functionally provides the combined difference of selected highpass output taps 1410 and 1415. The output of the combiner is bandpass filter output 1420. Note that the output tap 1410 has a lower corner frequency than output tap 1415, so that there is no phase inversion of the bandpass filter output signal. Selecting various output taps of the highpass filter will change the bandwidth. As output tap 1410 is varied, the lower corner frequency of the bandpass will change. As output tap 1415 is varied, the upper corner frequency of the bandpass will change.

Figure 15:
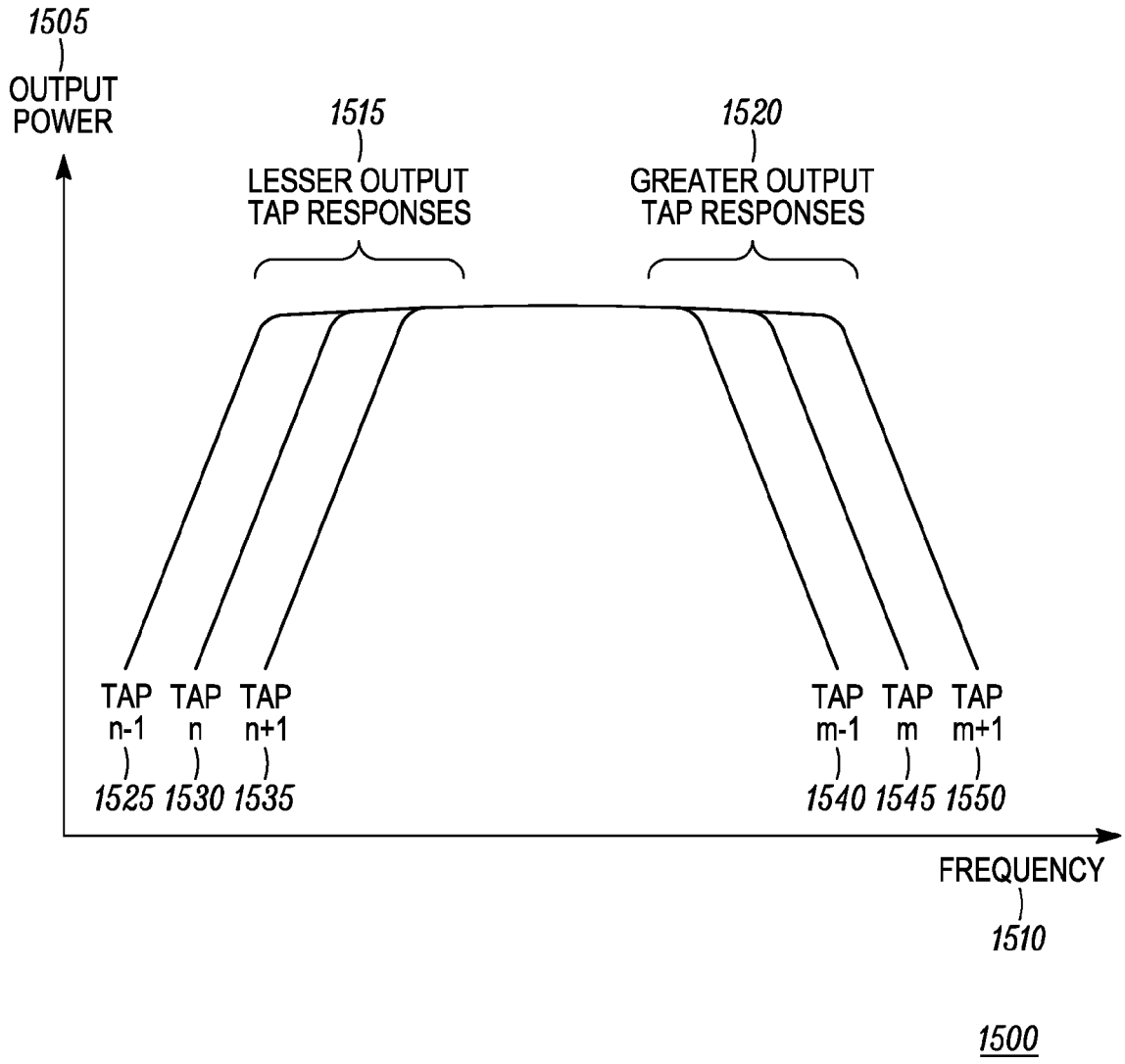
FIG. 15 is a family of plots of typical bandpass filter responses obtained by using two taps of a group of output taps of a highpass filter structure, utilized in accordance with certain embodiments of the present invention.

Refer to FIG. 15, which is a family of plots 1500 of typical bandpass filter responses obtained by using two taps of a group of output taps of a highpass filter structure, utilized in accordance with certain embodiments of the present invention. The vertical axis is output power 1505, and the horizontal axis is frequency 1510. The curves to the left are the highpass filter responses for selected tap 1410, and the family of curves to the right are the subtracted highpass responses for selected output tap 1415. Tap n−1 1525 provides the lowest corner frequency for output tap 1410, and tap n+1 1535 provides the highest corner frequency for output tap 1410. Tap n 1530 provides an intermediate corner frequency for the output tap 1410. Tap n−1 1540 provides the lowest corner frequency for output tap 1415, and tap n+1 1550 provides the highest corner frequency for output tap 1415. Tap n 1545 provides an intermediate corner frequency for the output tap 1415. The upper corner frequency of the bandpass filter is determined by selected output tap 1415, and the lower corner frequency of the bandpass filter is determined by selected output tap 1410. There is thus independent control over the upper and lower corner frequencies of the bandpass response. A selector device, not shown, such as a simple mechanical switch or switching circuitry, said circuitry being responsive to switch position selection or under software control, could be used to select any tap desired for selected output tap 1410, and in a similar manner for selected output tap 1415. Note that upper and lower corner frequencies of the bandpass response may be chosen individually, or in pairs, depending on requirements. In this way the composite bandpass filter of the present invention could provide a multiplicity of bandwidth selections simply under manual or software control.

Thus, it should be clear from the preceding disclosure that the present invention provides a method and apparatus for creating a highpass filter that has a flexible corner frequency, and that maintain the current drain and dynamic range performance of passive RF filters.

Those of ordinary skill in the art will appreciate that many other circuit and system configurations can be readily devised to accomplish the desired end without departing from the spirit of the present invention.

While the invention has been described in conjunction with specific embodiments, it is evident that many alternatives, modifications, permutations and variations will become apparent to those of ordinary skill in the art in light of the foregoing description. By way of example, other types of devices and circuits may be utilized for any component or circuit as long as they provide the requisite functionality. A further example is that the described circuitries may be implemented as part of an integrated circuit, or a hybrid circuit, or a discrete circuit, or combinations thereof. Yet another example is that the features of the present invention may be adapted to operate over a wide range of frequencies, up to and including RF frequencies. A further example is that tap selections may be accomplished by manual or automatic means, to include software control. Accordingly, it is intended that the present invention embrace all such alternatives, modifications and variations as fall within the scope of the appended claims.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The invention claimed is:

1. A method for creating a filter having an input, the method comprising:

forming a transmission line having characteristic impedance which increases at a first substantially exponential rate with respect to a distance from the input;

coupling to the transmission line a plurality of resonators positioned at a plurality of locations along the transmission line and having resonant frequencies which increase at a second substantially exponential rate with respect to the distance from the input; and obtaining an output signal at a point in the filter that produces a filter response having a corner frequency.

2. The method of claim 1, wherein obtaining comprises obtaining multiple output signals at multiple physically separated points in the filter to produce multiple filter responses having different corner frequencies.

3. The method of claim 1, wherein obtaining comprises:

obtaining at least two output signals from at least two physically separated points in the filter; and combining the at least two output signals to produce a bandpass response.

4. The method of claim 1, wherein forming comprises arranging the transmission line such that the characteristic impedance at a distal end of the transmission line divided by the characteristic impedance at the input is substantially equal to a desired upper operating frequency range limit divided by a desired lower operating frequency range limit.

5. The method of claim 1, wherein forming comprises forming a microstripline transmission line, tapered such that the characteristic impedance increases at a predetermined substantially exponential rate with respect to the distance from the input; and wherein coupling comprises coupling a plurality of microstripline stubs arranged such that, compared to a stub closest to the input, each additional stub decreases in length at said predetermined substantially exponential rate with respect to the distance from the input.

6. The method of claim 1, wherein obtaining comprises obtaining the output signal through at least one of a mechanical, an electric, a magnetic, and an electromagnetic coupling to a resonator of the plurality of resonators.

7. The method of claim 1, wherein obtaining comprises obtaining the output signal through at least one of a mechanical, an electric, a magnetic, and an electromagnetic coupling to the transmission line.

8. The method of claim 1, wherein coupling comprises forming the plurality of resonators such that the plurality of resonators have a substantially constant damping factor.

9. The method of claim 1, wherein the first substantially exponential rate and the second substantially exponential rate are substantially equal to one another.

10. A filter, the filter comprising:

an input for receiving an input signal;

a transmission line coupled to the input, the transmission line having characteristic impedance which decreases at a first substantially exponential rate with respect to a distance from the input;

a plurality of resonators coupled to the transmission line, the resonators positioned at a plurality of points along the transmission line and having resonant frequencies which increase at a second substantially exponential rate with respect to the distance from the input; and an output coupled to a point in the filter that produces a filter response having a corner frequency.

11. The filter of claim 10, further comprising a plurality of outputs coupled to a plurality of physically separated points in the filter for producing a plurality of output signals with a plurality of filter responses having different corner frequencies.

12. The filter of claim 10, further comprising:

at least two outputs coupled to at least two physically separated points in the filter for producing at least two output signals; and a combiner providing a combined filter output coupled to the at least two outputs for combining the at least two output signals to establish a bandpass response.

13. The filter of claim 12, wherein the bandpass corner frequencies of the combined filter output may be modified by selection of the two outputs.

14. The filter of claim 10, wherein the transmission line is arranged and formed such that the characteristic impedance at a distal end of the transmission line divided by the characteristic impedance at the input is substantially equal to a desired upper operating frequency range limit divided by a desired lower operating frequency range limit.

15. The filter of claim 10, wherein the transmission line is arranged and formed as a microstripline transmission line, tapered such that the characteristic impedance increases at a predetermined substantially exponential rate with respect to the distance from the input; and wherein the plurality of resonators are formed as a plurality of microstripline stubs arranged such that, compared to a stub closest to the input, each additional stub decreases in length at said predetermined substantially exponential rate with respect to the distance from the input.

16. The filter of claim 10, wherein the output comprises an element for obtaining the output signal through at least one of a mechanical, an electric, a magnetic, and an electromagnetic coupling to a resonator of the plurality of resonators.

17. The filter of claim 10, wherein the output comprises an element for obtaining the output signal through at least one of a mechanical, an electric, a magnetic, and an electromagnetic coupling to the transmission line.

18. The filter of claim 10, wherein the plurality of resonators are arranged and formed to have a substantially constant damping factor.

19. The filter of claim 10, wherein the first substantially exponential rate and the second substantially exponential rate are substantially equal to one another.

20. The filter of claim 10, further comprising:

a first filter having an input and an output; and a second filter having an input and an output, with the first filter input coupled to the second filter output;

wherein the first filter output is selected from a plurality of first filter outputs of the first filter that are coupled to a corresponding plurality of physically separated points in the first filter that produce the plurality of first filter output signals;

wherein the second filter output is selected from a plurality of second filter outputs of the second filter that are coupled to a corresponding plurality of physically separated points in the second filter that produce the plurality of second filter output signals;

wherein one of either the first filter or the second filter having a lowpass response, with the other filter having a highpass response; and wherein the first filter output is a bandpass response.

21. The filter of claim 20, wherein the bandpass corner frequencies of the first filter output may be modified by selection of the first filter output and selection of the second filter output.

22. The filter of claim 10, further comprising:

a first filter having an input and an output; and a second filter having an input and an output, with the first filter input coupled to the second filter output;

wherein the first filter output is selected from a plurality of first filter outputs of the first filter that are coupled to a corresponding plurality of physically separated points in the first filter that produce the plurality of first filter output signals;

wherein the first filter has a highpass response and the second filter has a lowpass response; and wherein the first filter output is a bandpass response.

23. The filter of claim 22, wherein the bandpass corner frequencies of the first filter output may be modified by selection of the first filter output.

24. The filter of claim 10, further comprising:

a first filter having an input and an output; and a second filter having an input and an output, with the first filter input coupled to the second filter input;

wherein the first filter output is selected from a plurality of first filter outputs of the first filter that are coupled to a corresponding plurality of physically separated points in the first filter that produce the plurality of first filter output signals;

wherein the second filter output is selected from a plurality of second filter outputs of the second filter that are coupled to a corresponding plurality of physically separated points in the second filter that produce the plurality of second filter output signals;

wherein the first filter has a highpass response and the second filter has a highpass response;

wherein the first filter output and the second filter output are combined to generate a combined filter output; and wherein the combined filter output is a bandpass response.

25. The filter of claim 24, wherein the corner frequencies of the combined filter output bandpass response may be modified by selection of the first filter output and the second filter output.

26. The filter of claim 10, further comprising:

a first filter having an input and an output; and a second filter having an input and an output, with the first filter input coupled to the second filter input; and wherein the first filter output is selected from a plurality of first filter outputs of the first filter that are coupled to a corresponding plurality of physically separated points in the first filter that produce the plurality of first filter output signals;

wherein the second filter output is selected from a plurality of second filter outputs of the second filter that are coupled to a corresponding plurality of physically separated points in the second filter that produce the plurality of second filter output signals;

wherein the first filter has a highpass response and the second filter has a lowpass response;

wherein the first filter output and the second filter output are combined to generate a combined filter output; and wherein the combined filter output is a bandstop response.

27. The filter of claim 26, wherein the bandstop corner frequencies of the combined filter output may be modified by selection of the first filter output and the second filter output.

28. The filter of claim 10, further comprising:

a first filter having an input and an output; and a second filter having an input and an output, with the first filter input coupled to the second filter input;

wherein the first filter output is selected from a plurality of first filter outputs of the first filter that are coupled to a corresponding plurality of physically separated points in the first filter that produce the plurality of first filter output signals;

wherein the first filter has a highpass response and the second filter has a lowpass response;

wherein the first filter output and the second filter output are combined to generate a combined filter output; and wherein the combined filter output is a bandstop response.

29. The filter of claim 28, wherein the bandstop corner frequencies of the combined filter output may be modified by selection of the first filter output.

* * * * *